US008474132B2

(12) United States Patent
Li et al.

(10) Patent No.: US 8,474,132 B2
(45) Date of Patent: Jul. 2, 2013

(54) PRODUCT LINE ASSEMBLY

(75) Inventors: Shen-Chun Li, Tu-Cheng (TW); Hsien-Chuan Liang, Tu-Cheng (TW); Shou-Kuo Hsu, Tu-Cheng (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 246 days.

(21) Appl. No.: 13/071,466

(22) Filed: Mar. 24, 2011

(65) Prior Publication Data

US 2012/0137509 A1 Jun. 7, 2012

(30) Foreign Application Priority Data

Dec. 7, 2010 (TW) ..... 99142685 A

(51) Int. Cl.

| | |
|---|---|
| ***B65G 21/00*** | (2006.01) |
| ***B65G 37/00*** | (2006.01) |
| ***B23P 21/00*** | (2006.01) |

(52) U.S. Cl.

USPC ..... 29/791; 29/771; 29/783; 29/822; 29/429; 29/430; 198/860.2; 198/346.2

(58) Field of Classification Search

USPC ..... 29/771, 783, 791, 795, 822, 429, 29/430, 431, 786, 793, 794; 198/860.2, 580, 198/346.2

See application file for complete search history.

(56) References Cited

U.S. PATENT DOCUMENTS

| | | | | |
|---|---|---|---|---|
| 5,174,707 | A * | 12/1992 | Suekane et al. | 414/269 |
| 2004/0255449 | A1 * | 12/2004 | Koren et al. | 29/430 |
| 2009/0056116 | A1 * | 3/2009 | Presley et al. | 29/791 |
| 2012/0266546 | A1 * | 10/2012 | Gyory et al. | 52/126.1 |

* cited by examiner

*Primary Examiner* — Alexander P Taousakis
*Assistant Examiner* — Jun Yoo
(74) *Attorney, Agent, or Firm* — Altis Law Group, Inc.

(57) ABSTRACT

A product line assembly includes a plurality of containers detachably connected. Each of the plurality of containers includes a case and equipment received in the case. Each container is configured for performing an individual working procedure.

9 Claims, 5 Drawing Sheets

PRODUCT LINE ASSEMBLY

BACKGROUND

1. Technical Field

The present disclosure generally relates to product line assemblies, and particularly to a product line assembly convenient for transportation and assembling.

2. Description of Related Art

Many conventional product lines include multiple working procedures each employing different types of equipment. The equipment is often detachably assembled, and cooperatively forms a bulky and complex configuration. During relocation of the product line, the equipment has to be disassembled first and then reassembled after it is transferred to a new destination. However, the bulky and complex configuration of the product line undesirably increases cost of the transfer and assembling.

Therefore, what is needed is an improved product line assembly, which is very convenient to transport and assemble.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure.

DETAILED DESCRIPTION

Reference will now be made to the drawings to describe the present disclosure in detail.

Figure 1:
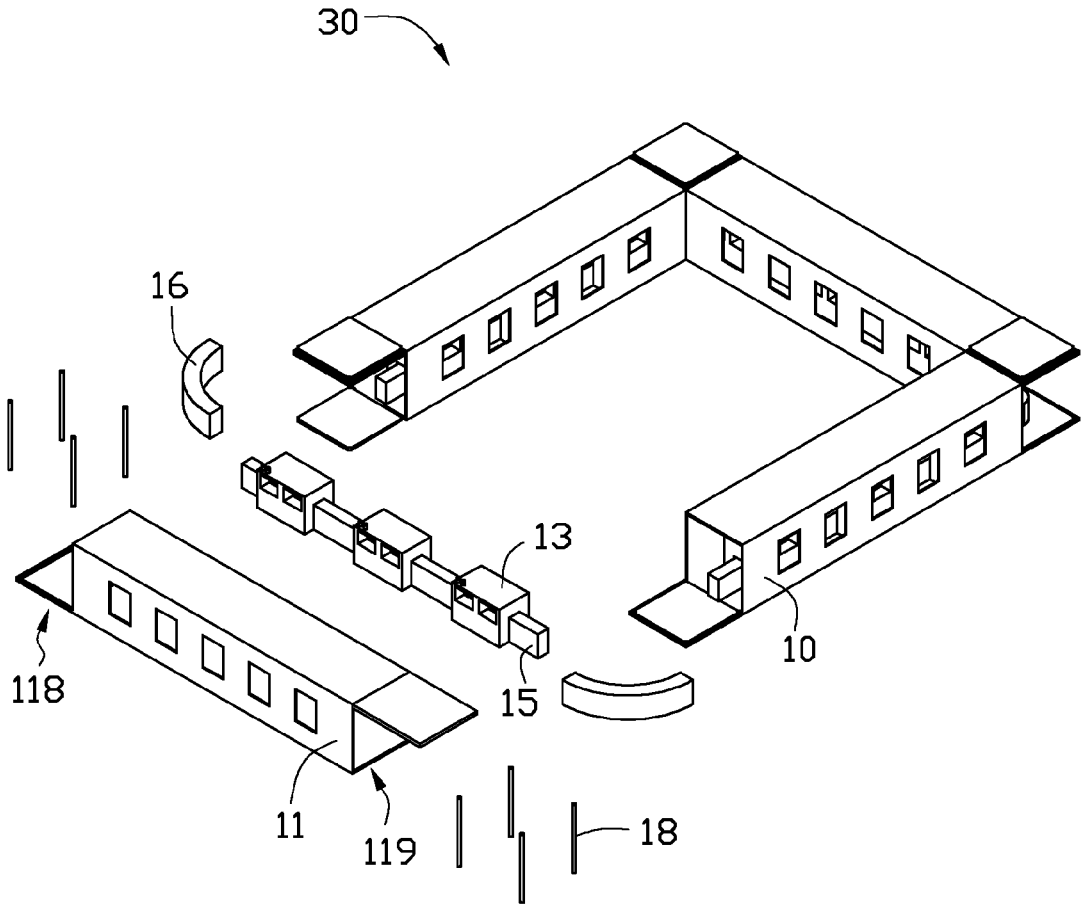
FIG. 1 is an exploded view of a product line assembly in accordance with a first exemplary embodiment of the present disclosure.
Figure 2:
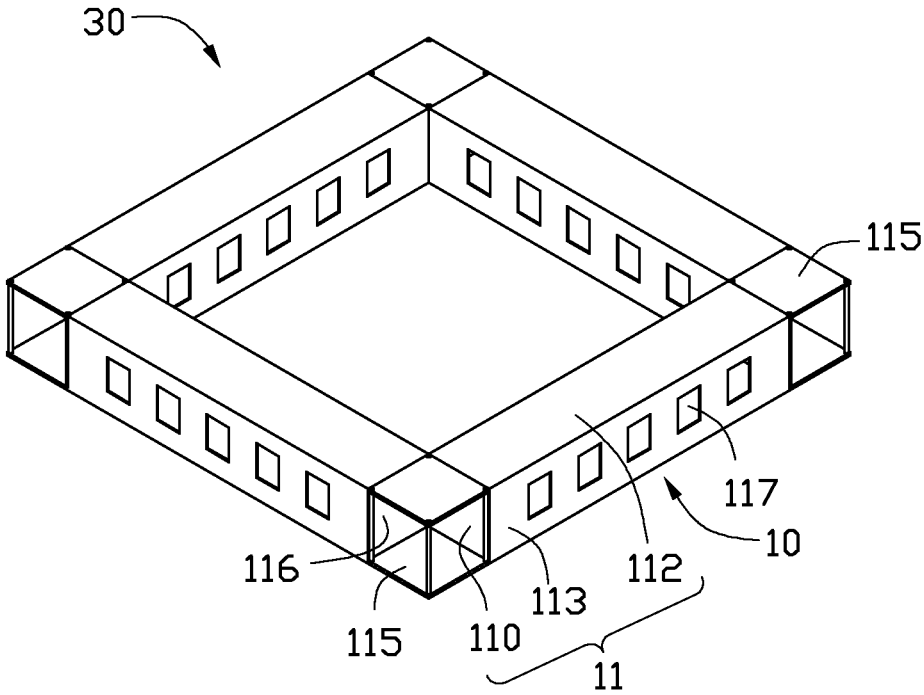
FIG. 2 is an assembled view of the product line assembly of FIG. 1.

Referring to FIG. 1 and FIG. 2, a product line assembly 30, according to a first exemplary embodiment, includes four containers 10 detachably connected with each other.

Each container 10 includes a hollow and rectangular case 11, a plurality of equipment 13 received in the case 11, and a conveyor 15 for transporting products to be machined.

The case 11 includes a rectangular and planar bottom plate 110, a rectangular and planar upper plate 112 parallel to the bottom plate 110, two side plates 113 interconnecting lateral sides of the bottom plate 110 and the upper plate 112, and two doors 115 located respectively at two distal ends 118, 119 of the case 11.

The bottom plate 110, the upper plate 112 and the two side plates 113 cooperatively form a space 116 for receiving the plurality of equipment 13 and the conveyor 15.

A first door 115 at one of the two distal ends of the case 11 as shown in FIG. 2 is pivoted to the bottom plate 110 at a distal edge thereof. The first door 115 is capable of being rotated around the distal edge of the bottom plate 110, thereby opening or closing the space 116 by the distal end of the case 11. A second door 115 at the other one of the two distal ends of the case 11 is pivoted to the upper plate 112 at a distal edge thereof. The second door 115 is capable of being rotated around the distal edge of the upper plate 112, thereby opening or closing the space 116 by the back distal end of the case 11.

The side plates 113 have a plurality of windows 117 formed thereon. Through the windows 117, an operating state of the equipment 13 can be monitored from outside. A number of windows 117 can be increased or decreased according to strength and size of the case 11.

Figure 3:
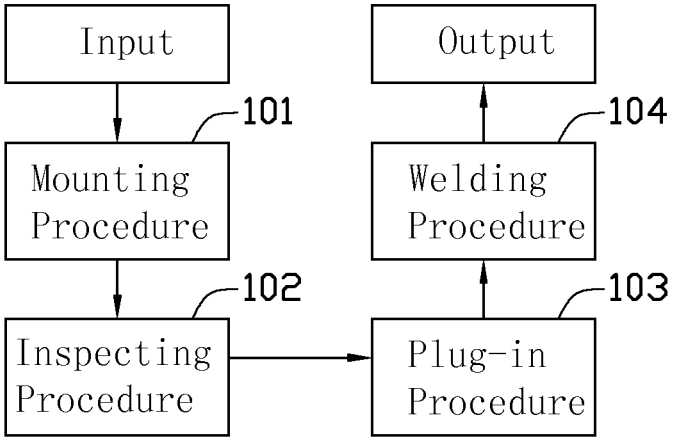
FIG. 3 is a flowchart of exemplary working procedures performed by the product line assembly of FIG. 1.

Referring to FIG. 3, a mechanism for the product line 30 (e.g., for making circuit boards) is introduced along with the following product line 30.

The product line 30 includes four cases 11 connected end to end. The four cases 11 are configured for respectively performing a mounting procedure 101, an inspecting procedure 102, a plug-in procedure 103 and a welding procedure 104. The case 11 for executing mounting procedure 101 has surface mounting technology (SMT) machines equipped therein. The case 11 for executing inspecting procedures 102 has automatic optics testing (AOT) machines and X-Ray inspecting machines equipped therein. The case 11 for executing plug-in procedures 103 has automatic plug-in machines equipped therein. The case 11 for executing welding procedure 104 has wave crest welding machines equipped therein.

At a joint of two neighboring cases 11, there are two doors 115 respectively belonging to one of the two neighboring cases 11. The two doors 115 are respectively pivoted to the bottom plate 110 of one case 11 and the upper plate 112 of the other case 11. Four fixing poles 18 are respectively arranged at four corners of the door 115 pivoted to the bottom plate 110, thereby supporting the door 115 pivoted to the upper plate 112. As such, the two doors 115 are fixed opposite to each other. A transferring conveyor 16 is employed to connect the two conveyors 15 of each two neighboring cases 11. As such, the four cases 11 for performing different working procedures are assembled into a single storey loop configuration to constitute the product line 30 for making circuit boards. The four containers 10 cooperatively transfer products horizontally through each case 11 for each corresponding working procedure in succession.

If the product line 30 is to be relocated, the assembled cases 11 can be separated by tearing down the fixing poles 18 and the transferring conveyors 16. After being transferred to a set destination, the cases 11 can be reassembled to constitute the product line 30 employing the fixing poles 18 and the transferring conveyor 16.

Furthermore, due to each of the cases 11 capability to perform an individual working procedure, one or more cases 11 of the product line 30 can be transferred with agility to other product lines to perform the corresponding working procedure(s).

Figure 4:
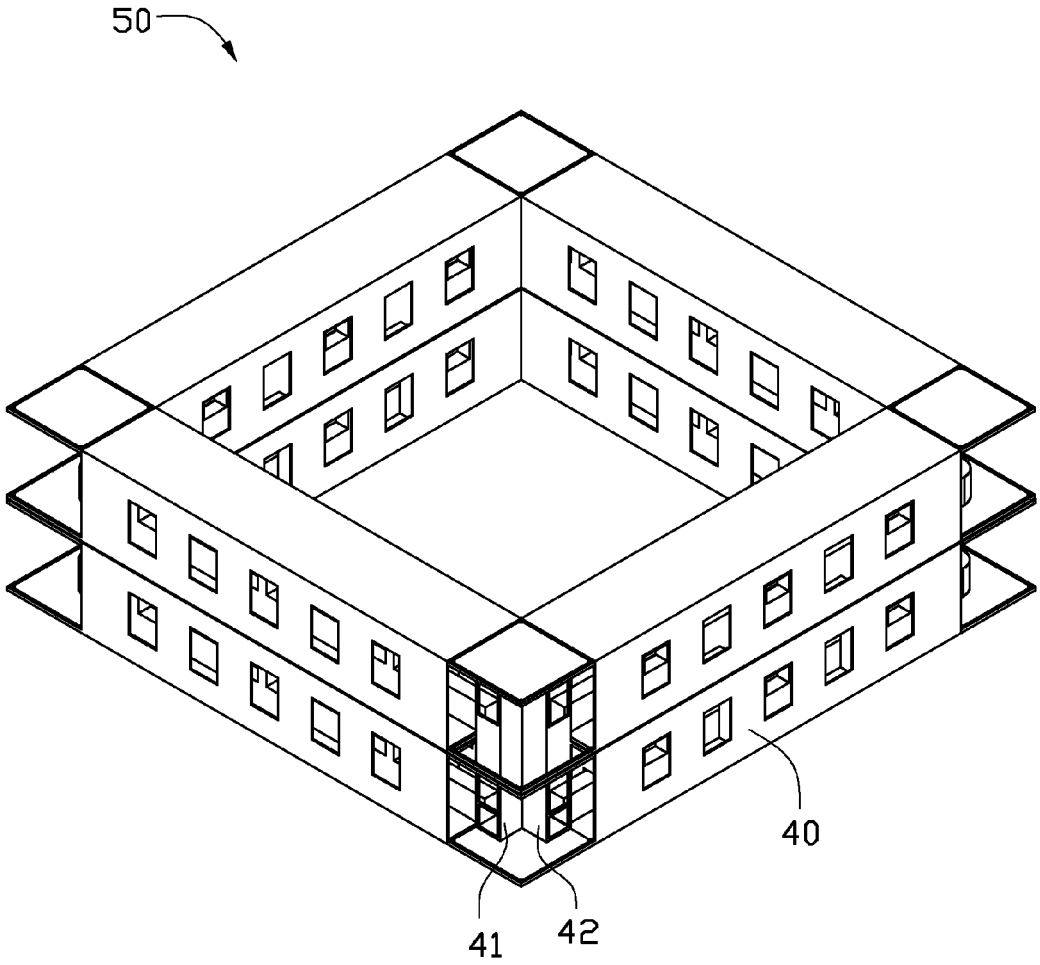
FIG. 4 is an assembly view of a product line assembly in accordance with a second exemplary embodiment of the present disclosure.
Figure 5:
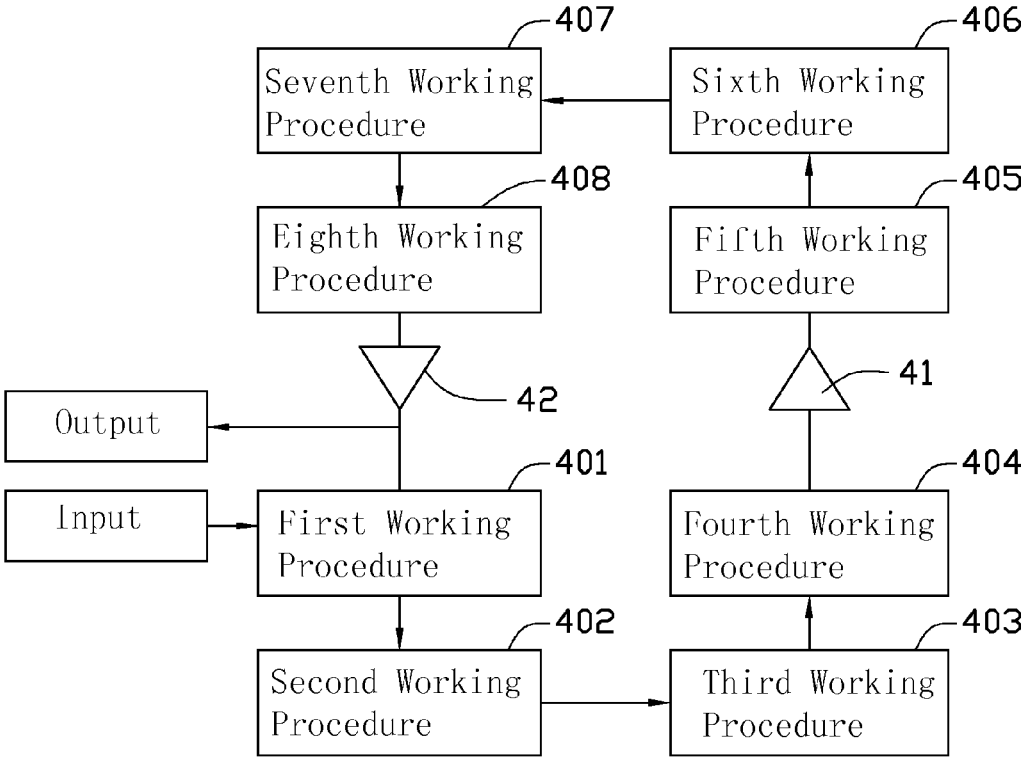
FIG. 5 is a flowchart of exemplary working procedures performed by the product line assembly of FIG. 4.

Referring to FIG. 4 and FIG. 5, a product line assembly 50, according to a second exemplary embodiment, includes eight containers 40 detachably assembled and stacked in double level configuration. Each of the eight containers 40 has a configuration similar to that of the containers 10. Each of the eight containers 40 has machine(s) received therein for performing a corresponding working procedure different from that of the others. The four containers 40 on the lower level respectively perform a first working procedure 401, a second working procedure 402, a third working procedure 403 and a fourth working procedure 404. The four containers 40 on the upper level respectively perform a fifth working procedure 405, a sixth working procedure 406, a seventh working procedure 407 and a eighth working procedure 408.

The container 40 for performing the fifth working procedure 405 is configured above the container 40 for performing the fourth working procedure 404, and a lifting device 41 is provided there between. The container 40 for performing the eighth working procedure 408 is configured above the container 40 for performing the first working procedure 401, and a lowering device 42 is provided there between.

As such, products to be machined can be input to the container 40 corresponding to the first working procedure 401. Then successively conveyed horizontally to the containers 40 corresponding to the second, third and fourth working procedures 402, 403, 404 by conveyors (not illustrated). Lifted up vertically to the container 40 corresponding to the fifth working procedure 405 by the lifting device 41, successively conveyed horizontally to the containers 40 corresponding to the sixth, seventh and eighth working procedures 406, 407, 408 by conveyors (not illustrated), and lowered down vertically for output. According to this embodiment, the product line assembly 50 with numerous working procedures can also be configured without occupying more space than the product line assembly 10 disclosed above.

It is to be said that, the total amount of the containers 10, 40 and fixing poles 18 can vary according to an actual amount of desired working procedures. The fixing poles 18 can also be replaced by other devices with similar or same function (for example buckle devices), and the containers 10 can be assembled to have three or more stories.

It is to be understood that the above-described embodiments are intended to illustrate rather than limit the disclosure. Variations may be made to the embodiments without departing from the spirit of the disclosure as claimed. The above-described embodiments illustrate the scope of the disclosure but do not restrict the scope of the disclosure.

What is claimed is:

1. A product line assembly, comprising a plurality of containers detachably connected together, wherein each of the plurality of containers comprises a case and equipment received in the case for performing a working procedure;

wherein each of the cases comprises two doors respectively at two distal ends thereof, the doors each being capable of rotating to open or close the corresponding case by one end, each two neighboring cases have one of their doors adjacent and opposite to each other, and a plurality of fixing poles are fixed to and between the opposite two doors.

2. The product line assembly according to claim 1, wherein the plurality of containers each comprises a conveyor received therein, and the conveyors of the plurality of containers are connected by the conveyors.

3. The product line assembly according to claim 1, wherein the plurality of containers are detachably connected into a single storey loop configuration.

4. The product line assembly according to claim 1, wherein the plurality of containers are detachably connected into a multiple storey loop configuration, at least one lifting device and at least one lowering device are provided between two containers of neighboring storey.

5. The product line assembly according to claim 1, wherein each of the cases comprises an upper plate, a bottom plate and side plates interconnecting lateral sides of the bottom plate and the upper plate, and the two doors of each case are respectively formed on the bottom plate and the upper plate at two distal ends.

6. The product line assembly according to claim 5, wherein the side plates have a plurality of window configured thereon.

7. A product line assembly, comprising a plurality of containers capable of being detachably connected and stacked together, wherein each of the plurality of containers comprises a case and equipments received in the case for performing a working procedure; wherein each of the cases comprises two doors respectively at two distal ends thereof, the doors each being capable of rotating to open or close the corresponding case by one end, each two neighboring cases have one of their doors adjacent and opposite to each other, and a plurality of fixing poles are fixed to and between the opposite two doors.

8. The product line assembly according to claim 7, wherein the plurality of containers are detachably connected into a single storey loop configuration, and the plurality of containers cooperatively transfer products horizontally through each working procedure in succession.

9. The product line assembly according to claim 7, wherein the plurality of containers are detachably connected into a multiple storey loop configuration, and the plurality of containers cooperatively transfer products horizontally and vertically through each working procedure in succession.

* * * * *